US011035121B2

(12) United States Patent
Klein et al.

(10) Patent No.: US 11,035,121 B2
(45) Date of Patent: Jun. 15, 2021

(54) THERMAL AND ACOUSTIC INSULATING AND SEALING SYSTEM FOR A SAFING SLOT IN A CURTAIN WALL

(71) Applicant: HILTI AKTIENGESELLSCHAFT, Schaan (LI)

(72) Inventors: Manfred Klein, Kaufering (DE); Christian Foerg, Dillishausen (DE); Mario Paetow, Igling (DE); Markus Koegler, Kaufering (DE); Arndt Andresen, Irving, TX (US)

(73) Assignee: HILTI AKTIENGESELLSCHAFT, Schaan (LI)

( * ) Notice: Subject to any disclaimer, the term of this patent is extended or adjusted under 35 U.S.C. 154(b) by 238 days.

(21) Appl. No.: 16/303,112

(22) PCT Filed: Apr. 20, 2017

(86) PCT No.: PCT/EP2017/059357
§ 371 (c)(1),
(2) Date: Nov. 19, 2018

(87) PCT Pub. No.: WO2017/198413
PCT Pub. Date: Nov. 23, 2017

(65) Prior Publication Data

US 2020/0332525 A1 Oct. 22, 2020

(30) Foreign Application Priority Data

May 20, 2016 (EP) ..... 16170528

(51) Int. Cl.
*E04B 2/96* (2006.01)
*E04B 1/94* (2006.01)
*E04B 1/66* (2006.01)

(52) U.S. Cl.
CPC ..... *E04B 2/967* (2013.01); *E04B 1/66* (2013.01); *E04B 1/948* (2013.01)

(58) Field of Classification Search
CPC ..... E04B 1/66; E04B 1/948; E04B 2/967
(Continued)

(56) References Cited

U.S. PATENT DOCUMENTS 2,914,145 A * 11/1959 Benson ..... E04B 2/96 52/235
3,210,898 A * 10/1965 Kurtz ..... E04B 1/2608 52/281

(Continued)

FOREIGN PATENT DOCUMENTS

| | | |
|---|---|---|
| CA | 2 510 989 | 1/2006 |
| JP | 08060752 A * | 3/1996 |
| KR | 10-1131986 | 3/2012 |

OTHER PUBLICATIONS

International Search Report dated May 26, 2017 in PCT/EP2017/059357.

(Continued)

*Primary Examiner* — Patrick J Maestri
*Assistant Examiner* — Joseph J. Sadlon
(74) *Attorney, Agent, or Firm* — Grüneberg and Myers PLLC

(57) ABSTRACT

Described is a construction and parts of the construction for effectively thermally and acoustically insulating and sealing of a safing slot (1) between a floor (6) of a building and an exterior wall construction wherein the exterior wall construction comprises a curtain wall configuration (2) utilizing an interior panel module design. In particular, the thermal insulating and sealing system comprises a first element (7) comprising a top framing component (8) having an interior wall surface (13) and an opening, positioned substantially in the height of the floor (6), wherein the top framing compo- (Continued)

nent (8) is located on top of the interior wall surface (3) of the spandrel panel (7), and a second element (9) comprised of a thermally resistant and/or air tight material for insulating, positioned at least partially in the top framing component (8) of the first element (7), wherein the second element (9) includes an inner end surface (10) positionable in abutment with respect to the outer edge (11) of the floor (6) for sealing thereadjacent, outer end surface (12) positionable in abutment with respect the interior wall surface (13) of the top framing component (8), a lower facing surface (14) extending between the inner end surface (10) and the outer end surface (12) and facing downwardly therebetween, and an upper facing surface (15) extending between the inner end surface (10) and the outer end surface (12) and facing upwardly therebetween.

18 Claims, 3 Drawing Sheets

(58) Field of Classification Search
USPC ..... 52/235
See application file for complete search history.

(56) References Cited

U.S. PATENT DOCUMENTS 3,736,709 A * 6/1973 Koch ..... E04B 1/04 52/97
4,220,685 A * 9/1980 Markow ..... B60R 13/08 165/135
4,449,341 A * 5/1984 Taglianetti ..... E04B 2/88 52/235
5,154,029 A * 10/1992 Sturgeon ..... E04F 13/12 52/235
5,333,428 A * 8/1994 Taylor ..... B44C 5/08 264/254
5,467,566 A * 11/1995 Swartz ..... E04B 2/96 52/235
5,502,937 A * 4/1996 Wilson ..... B32B 15/14 52/273
6,484,465 B2 * 11/2002 Higgins ..... E04F 13/081 52/235
6,651,390 B2 * 11/2003 Camperelli ..... E05B 15/0205 49/504
6,729,080 B1 * 5/2004 Zambelli ..... E04B 2/94 52/167.1
7,424,793 B1 * 9/2008 Shriver ..... E04B 2/88 52/235
7,600,350 B2 * 10/2009 Braunstein ..... E04B 2/96 52/173.3
7,644,549 B2 * 1/2010 Speck ..... E04B 2/90 52/235
7,827,746 B2 * 11/2010 Speck ..... E04B 2/90 52/235
7,856,775 B2 12/2010 Stahl, Jr.
8,091,846 B1 * 1/2012 Britner ..... B25H 1/00 248/219.3
8,484,916 B2 * 7/2013 Farag ..... B32B 17/10055 52/235
8,950,132 B2 * 2/2015 Collins ..... E04B 2/82 52/236.3
8,973,316 B2 * 3/2015 Safford ..... E04B 2/885 52/204.62
8,998,527 B2 * 4/2015 Clark ..... F16B 7/0473 403/231
9,016,010 B2 * 4/2015 Sonderkær ..... E06B 3/66328 52/209
2007/0204540 A1 9/2007 Stahl et al.
2009/0126297 A1 * 5/2009 Stahl, Jr. ..... E04B 2/88 52/235
2013/0061544 A1 3/2013 Stahl et al.
2013/0086857 A1 * 4/2013 Paetow ..... F16L 5/04 52/232
2015/0113891 A1 * 4/2015 Evensen ..... E04B 2/96 52/204.7

OTHER PUBLICATIONS

Written Opinion dated May 26, 2017 in PCT/EP2017/059357.
Technisches Handbuch Brandschutzsysteme11, HILTI DE, Oct. 1, 2013 (Oct. 1, 2013), XP055140498, https://www.hilti.de/medias/sysmaster/doc uments/h4d/9107975602206.pdf?mime=application/pdf&realname=Technisches Handbuch Brandschutzsysteme.pdf p. 3: schematic vertical—view of a facade.

* cited by examiner

THERMAL AND ACOUSTIC INSULATING AND SEALING SYSTEM FOR A SAFING SLOT IN A CURTAIN WALL

This application is a National Stage entry under § 371 of International Application No. PCT/EP2017/059357, filed on Apr. 20, 2017, and claims priority to European Patent Application No. 16170528.0, filed on May 20, 2016, the entire contents of which are hereby incorporated by reference.

FIELD OF THE INVENTION

The present invention relates to the field of constructions and systems designed to thermally and acoustically insulate and seal a safing slot area defined between a curtain wall and the individual floors of a building. In particular, the present invention relates to a thermal as well as acoustic insulating and sealing system for use with curtain wall structures which include an interior panel such as a back pan or other similar construction which can be of metal or other material extending across the interior surface of a curtain wall which is common in modular designs. The interior panels of a curtain wall are generally made from a metal or insulation material which can easily bend, distort or be otherwise deformed when exposed to strong winds or elevated temperatures, such as intensive sunlight or heat, such as in the event of a fire. Bending, distorting or deforming of these interior panels can result in significant problems in attempting to maintain a complete thermal insulation and seal within the safing slots between the outer edges of the floor construction and the exterior curtain wall construction during a storm or fire. In particular, maintaining of a complete thermal insulation and seal at all time during a fire is important to prevent heat, smoke and flames from spreading from one floor to an adjacent floor.

BACKGROUND OF THE INVENTION

Curtain walls are general used and applied in modern building constructions and are the outer covering of said constructions in which the outer walls are non-structural, but merely keep the weather out and the occupants in. Curtain walls are usually made of a lightweight material, reducing construction costs. The wall transfers horizontal wind loads that are incident upon it to the main building structure through connections at floors or columns of the building. Curtain walls are designed to resist air and water infiltration, sway induced by wind and seismic forces acting on the building, and its own dead load weight forces. Curtain walls differ from store-front systems in that they are designed to span multiple floors, and take into consideration design requirements such as thermal expansion and contraction, building sway and movement, water diversion, and thermal efficiency for cost-effective heating, cooling, and lighting in the building.

A curtain wall structure is defined by an interior wall surface, which includes an interior panel, such as a back pan, extending over the interior surface thereof and at least one floor spatially disposed from the inner wall surface. The gap between the floor and the back pan of a curtain wall defines a safing slot, also referred to as perimeter slab edge, extending between the interior wall surface of the interior panel and the outer edge of the floor. This safing slot is essential to slow the passage of fire and combustion gases between floors. Moreover, the safing slot is needed to compensate dimensional tolerances of the concreted floor and to allow movement between the floor and the façade element caused by load, temperature or wind load.

Therefore, it is of great importance to improve firestopping at the safing slot in order to keep heat, smoke and flames from spreading from one floor to an adjacent floor. It is important to note that the firestop at the perimeter slab edge is considered a continuation of the fire-resistance rating of the floor slab. The curtain wall itself, however, is not ordinarily required to have a rating.

Various designs have been known for curtain wall constructions and for means for thermally insulating and sealing the safing slot. A typical curtain wall configuration comprises a profiled framework of vertical studs, so called mullions, and horizontal studs, so called transoms. The space between these profiles is either filled with glass panels within the window area or spandrel panels within the front of the floors. A common spandrel design comprises a pre-manufactured metal pan filled with insulating material. The remaining gap between spandrel and floor has to be sealed against fire, smoke and sound and withstand certain movement.

U.S. Pat. No. 7,856,775 B2 describes an insulating system including a supplemental insulation belt positioned beneath the safing insulation and attached to the interior panel of a curtain wall construction to maintain sealing of the safing slot during exposure to fire and heat which can cause the interior panel to deform from heat warping to an extent beyond the capability of standard safing insulation for expanding in order to maintain a proper seal extending across the safing slot. Other insulating systems are described in US 2007/0204540 A1 and US 2013/061544 A1.

Current solutions also provide sealing using pre-compressed mineral wool covered by an elastic coating. All these solutions have several drawbacks, such as that the installation of a highly pre-compressed mineral wool is labor intensive and not failure proof. The interface between metal pan and gap insulation is the weak point of the insulating system which is not sufficiently addressed by the current solutions. Further, additional and expensive equipment is needed to install the essential fire-stop spray coating. Often the installation process is weather dependent, the mineral wool can absorb water and the coating needs a certain drying time.

Therefore, there is a need for systems that overcome the disadvantages of the prior art systems, in particular, there is a need for systems that can be easily installed within a safing slot, where, for example, access is only needed from one side, implementing a one-sided application. Further, there is a need for systems that are not limited to the width of a joint of a curtain wall structure thereby compensating at the same time dimensional tolerances of the concreted floor and allowing movement between the floor and the façade element caused by load, temperature or wind load. Additionally, maintaining safing insulation between the floors of a residential or commercial building and the exterior curtain wall responsive to various conditions including fire exposure should be guaranteed. Moreover, there is a need for systems that improve fire-resistance as well as sound-resistance and can be easily integrated during installation of the curtain wall structure.

In view of the above, it is an object of the present invention to provide a spandrel panel for use in a curtain wall construction, which can be installed on site and hence is part of a modular or prefabricated curtain wall design.

Further, an object of the present invention to provide a thermal insulating and sealing system for thermally insulation and sealing of a safing slot in a building containing a curtain wall structure. In particular, it is an object of the present invention to provide a thermal insulating and sealing system which can be easily installed from one side, which maintains the safing insulation between the floors of a residential or commercial building and the exterior curtain wall responsive to various conditions, including fire exposure, and to maximize safing insulation at a minimal cost. Moreover, it is an object to provide a thermal insulating and sealing system which has no limitation of vertical as well as horizontal movement capacities, limitation to spandrel height as well as the ability to compensate dimensional tolerances of the concreted floor and to allow movement between the floor and the façade element caused by load, temperature or wind load.

Further, it is an object of the present invention to provide a top framing component for use within the spandrel area of a curtain wall construction which can be installed on site and hence is part of a modular or prefabricated curtain wall design.

Still further, it is an object of the present invention to provide a building construction comprising such a spandrel panel or top framing component or such a thermal insulating and sealing system, respectively, for effectively thermally insulating and sealing of the safing slot between a curtain wall structure and the edge of a floor.

Still further, it is an object to provide at the same time an acoustic insulating and sealing system for effectively acoustically insulating and sealing of the safing slot between a curtain wall structure and the edge of a floor.

These and other objectives as they will become apparent from the ensuring description of the invention are solved by the present invention as described in the independent claims. The dependent claims pertain to preferred embodiments.

SUMMARY OF THE INVENTION

In one aspect, the present invention provides a spandrel panel for use in a curtain wall construction defined by an interior wall surface including one or more framing members and at least one floor spatially disposed from the interior wall surface of the curtain wall construction, wherein the spandrel panel comprises an exterior wall surface and an interior wall surface, characterized in that the spandrel panel comprises a top framing component.

In another aspect, the present invention provides a thermally insulating and sealing system for effectively thermally insulating and sealing of a safing slot within a building construction having a curtain wall construction defined by an interior wall surface, including one or more framing members and a spandrel area, and at least one floor spatially disposed from the interior wall surface of the curtain wall construction defining the safing slot extending between the interior wall surface of the curtain wall construction and an outer edge of the floor, comprising a first element comprising a top framing component having an interior wall surface and an opening, positioned substantially in the height of the floor, wherein the top framing component is located on top of the spandrel area of the interior wall surface, and a second element comprised of a thermally resistant and/or air tight material for insulating, positioned at least partially in the top framing component of the first element, wherein the second element includes an inner end surface positionable in abutment with respect to the outer edge of the floor for sealing thereadjacent, outer end surface positionable in abutment with respect the interior wall surface of the top framing component, a lower facing surface extending between the inner end surface and the outer end surface and facing downwardly therebetween, and an upper facing surface extending between the inner end surface and the outer end surface and facing upwardly therebetween.

In yet another aspect, the present invention provides a top framing component for use within the spandrel area of a curtain wall construction defined by an interior wall surface including one or more framing members and at least one floor spatially disposed from the interior wall surface of the curtain wall construction, wherein the top framing component is preferably a compartment having a base and at least two sides, preferably perpendicular or trapezoidal, to the base with an opening parallel to the base.

In yet another aspect, the present invention provides a building construction comprising said thermal insulating and sealing system.

In yet another aspect, the present invention provides a thermal insulating and sealing system which is suitable for acoustically insulating and sealing of a safing slot of a curtain wall structure.

BRIEF DESCRIPTION OF THE FIGURES

The subject matter of the present invention is further described in more detail by reference to the following figures.

DETAILED DESCRIPTION OF THE INVENTION

Figure 1:
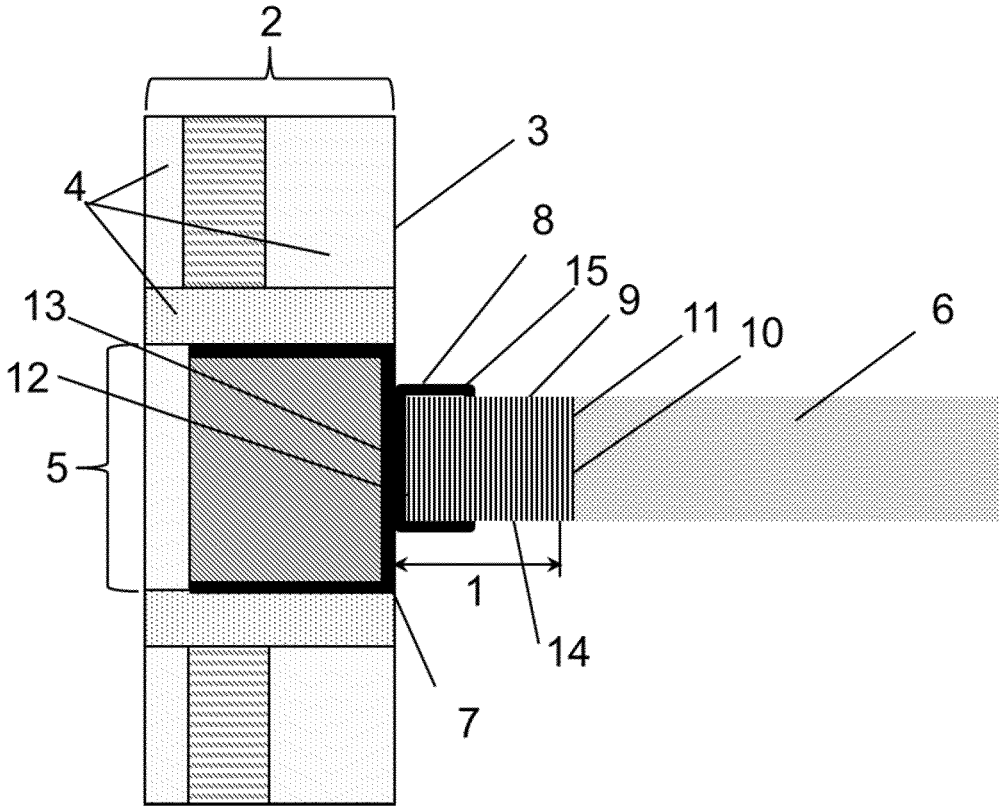
FIG. 1 shows a side cross-sectional view of an embodiment of the thermal insulating and sealing system between the outer edge of a floor and the interior wall surface of the interior panel having a top framing component.

The following terms and definitions will be used in the context of the present invention:

As used in the context of present invention, the singular forms of "a" and "an" also include the respective plurals unless the context clearly dictates otherwise. Thus, the term "a" or "an" is intended to mean "one or more" or "at least one", unless indicated otherwise.

The term "curtain wall structure" in context with the present invention refers to a wall structure which is defined by an interior wall surface, including an interior panel, such as a back pan, extending over the interior surface thereof and at least one floor spatially disposed from the inner wall surface.

The term "safing slot" in context with the present invention refers to the gap between a floor and a back pan of a curtain wall; it is also referred to as "perimeter slab edge", extending between the interior wall surface of the interior panel, i. e. back pan, and the outer edge of the floor.

The term "interior panel" in context with the present invention refers, in particular, to a back pan, preferably a steel back pan also referred to as spandrel panel.

The present invention pertains to a thermal insulating and sealing system and parts thereof for effectively thermally insulating and sealing of a safing slot within a building construction having a curtain wall construction defined by an interior wall surface, including one or more framing members and a spandrel area, and at least one floor spatially disposed from the interior wall surface of the curtain wall construction defining the safing slot extending between the interior wall surface of the curtain wall construction and an outer edge of the floor. The curtain wall back pan safing insulation system and parts thereof of the present invention is considered for the purpose of facilitating firestopping and soundstopping of as well as movement within a safing slot present in those buildings utilizing curtain wall structures for the exterior cladding thereof which includes interior panels, such as back pans, which are often made of materials that can deform responsive to exposure to heat.

A curtain wall structure is a type of exterior wall system commonly utilized on buildings wherein the curtain wall itself is a non-bearing wall. Such curtain walls generally are of a relatively lightweight material and commonly include metal skins. This type of construction is normally used in high-rise buildings for providing a relatively lightweight and inexpensive overall construction.

Spandrel panels are included in the curtain wall structure to provide the exterior facing thereof and such panels are commonly made of glass, aluminum, thin sheets of foam material and the like. One particular type of unitized wall structure which is often used in modular constructions includes an interior panel comprising a metallic sheet extending across the internal membrane and this metal sheet is referred to as the back pan. Such curtain wall systems commonly include vertical framing members comprising boxed aluminum channels referred to as mullions and similarly configured horizontally extending pieces as referred to as transoms. Such a transom located or transom configuration at floor level is also known as zero spandrel, i.e., bottom of the transom at the level as top of the concrete floor. The interior panels of curtain wall structures can be made of many materials and many of these materials are susceptible to distorting responsive to high heat conditions. Some of these panels are made from metallic materials but other non-metallic materials can also be used for these interior panels which are also capable of distorting such as insulation and aluminum clad insulation and many other materials. The thermal and acoustic insulating and sealing system and parts thereof according to the present invention are applicable for all types of curtain wall structures. Parts include a spandrel panel and a top framing component, respectively.

The spandrel panel according to the present invention is for use in a curtain wall construction defined by an interior wall surface including one or more framing members and at least one floor spatially disposed from the interior wall surface of the curtain wall construction. The spandrel panel comprises an exterior wall surface and an interior wall surface, and is characterized that it comprises a top framing component. The top framing component of the spandrel panel of the present invention is a preferably a compartment having a base and at least two sides, preferably perpendicular or trapezoidal, most preferably perpendicular, to the base with an opening parallel to the base. In particular, the top framing component of the spandrel area is in form of a U-shaped, rectangular channel. In a preferred embodiment of the present invention, the top framing component of the spandrel area is made from a rigid material, preferably a metal material or a concrete material, most preferably a metal material, such as steel. The rigid material of the top framing component reinforces the steel back pan construction and reduces deformation of the metal back pan caused by heat.

According to the present invention, the top framing component is positioned with its base on top of the interior wall surface of the spandrel panel so that its opening is parallel and pointing away from the exterior wall surface of the spandrel panel. The top framing component is designed to receive a thermally resistant and/or air tight material for insulating. In a particular preferred embodiment of the spandrel panel, the top framing component is filled with a thermally resistant and/or air tight material for insulating. Such thermally resistant and/or air tight materials include but are not limited to mineral wool materials, rubber-like materials or foams, such for example an elastomeric interlaced foam based on synthetic rubber (Armaflex), a polyethylene foam, a polyurethane foam, a polypropylene foam or a polyvinyl chloride foam. In particular, the thermally resistant and/or air tight material may be an open-cell or closed-cell foam-based material, for example a polyurethane-based or silicone-based material. In a particular preferred embodiment of the present invention, the thermally resistant and/or air tight material for insulating is a mineral wool material, a polyurethane foam or an elastomeric interlaced foam based on synthetic rubber.

The spandrel panel and the top framing component can be made from one material, for example by molding or welding, or from different materials. If the spandrel panel and the top framing component are of different materials, the top framing component is attached by attachment means to the spandrel panel. Preferred attachment means include at least one adhesive means, pin means, tongue and groove means, screw means or barbed hook means. The at least one pin or screw means preferably extends through one or more fixing points on the base of the top framing component and is attached to the interior wall surface of the spandrel panel. However, other attachment devices may be used to attach the top framing component according to the present invention. The top framing component can also be composed of non-combustible insulation material. It is also possible to fix the top framing member directly with hooks or anchors to the adjacent framing material or by welding.

The spandrel panel can be installed on site and hence is part of a modular or prefabricated curtain wall design and forms part of the thermal insulating and sealing system. The spandrel panel of the present invention is also suitable for acoustically insulating and sealing of a safing slot of a curtain wall structure. Top-mounting the framing member to the spandrel panel has the advantage that the façade design is not altered and that the framing member can be fixed in various back pan designs.

The thermally insulating and sealing system of the present invention, for effectively thermally insulating and sealing of a safing slot within a building construction having a curtain wall construction defined by an interior wall surface, including one or more framing members and a spandrel area, and at least one floor spatially disposed from the interior wall surface of the curtain wall construction defining the safing slot extending between the interior wall surface of the curtain wall construction and an outer edge of the floor, comprises:

i) a first element comprising a top framing component having an interior wall surface and an opening, positioned substantially in the height of the floor, wherein the top framing component is located on top of the interior wall surface of the spandrel panel, and ii) a second element comprised of a thermally resistant and/or air tight material for insulating, positioned at least partially in the top framing component of the first element, wherein the second element includes:

a) an inner end surface positionable in abutment with respect to the outer edge of the floor for sealing thereadjacent, b) an outer end surface positionable in abutment with respect the interior wall surface of the top framing component, c) a lower facing surface extending between the inner end surface and the outer end surface and facing downwardly therebetween, and d) an upper facing surface extending between the inner end surface and the outer end surface and facing upwardly therebetween.

In particular, the top framing component of the first element of the thermally insulating and sealing system according to the present invention is a compartment having a base and at least two sides, preferably perpendicular or trapezoidal, to the base with an opening parallel to the base. Preferably, the top framing component of the spandrel area is in form of a U-shaped, rectangular channel. The top framing component is positioned with its base on top of the interior wall surface of the spandrel panel so that its opening is parallel and pointing away from the exterior wall surface of the spandrel panel. The top framing component of the first element of the thermally insulating and sealing system according to the present invention is made from a rigid material, preferably a metal material, concrete material or compressed mineral wool, most preferably a metal material, such as steel. A rigid material of the top framing component reinforces the steel back pan construction and reduces deformation of the metal back pan caused by heat.

The second element of the thermally insulating and sealing system according to the present invention is comprised of a thermally resistant and/or air tight material. Preferably, the second element of the thermally insulating and sealing system for insulating is positioned at least partially in the top framing component of the first element, and includes an inner end surface positionable in abutment with respect to the outer edge of the floor for sealing thereadjacent, an outer end surface positionable in abutment with respect the interior wall surface of the top framing component, a lower facing surface extending between the inner end surface and the outer end surface and facing downwardly therebetween, and an upper facing surface extending between the inner end surface and the outer end surface and facing upwardly therebetween. The thermally resistant and/or air tight material of the second element comprises a thermally resistant and/or air tight flexible mineral wool material, rubber-like material or a foam, such for example an elastomeric interlaced foam based on synthetic rubber (Armaflex), a polyethylene foam, a polyurethane foam, a polypropylene foam or a polyvinyl chloride foam, to facilitate placement thereof into the safing slot. In particular, the thermally resistant and/or air tight material may be an open-cell or closed-cell foam-based material, for example a polyurethane-based or silicone-based material. In a particular preferred embodiment of the present invention, the thermally resistant and/or air tight material is a thermally resistant flexible mineral wool material, a polyurethane foam or an elastomeric interlaced foam based on synthetic rubber. It is preferred that the thermally resistant flexible mineral wool material is installed with fibers running parallel to the outer edge of the floor and the base of the first element.

By positioning the second element in the top framing component located on top of the interior wall surface of the spandrel panel, the construction strength is enhanced during a fire due to the additional stabilization of the panel and by avoiding a persistent joint. By using a top framing component on top of a spandrel panel, the second element can be designed as a drawer with a sealing area on top and/or bottom allowing using a more rigid material for the second element.

There is no specific means of attachment between the surfaces of the second element and the at least one wall of the top framing component. These surfaces can laterally slide along one another while maintaining abutting contact therebetween. This sliding relative movement would occur responsive to deforming of the interior panel; however additional sealing can enhance maintaining sealing of the safing slot. It should be appreciated that the dimension of the first element can be varied significantly to accommodate various configurations of different interior panels and safing slots in order to accommodate and effective thermally insulate and seal any such safing slot.

According to the present invention, the thermal insulating and sealing system further comprises a connecting third element comprised of a thermally resistant and/or air tight material for insulating, positioned in front of the vertical framing member and in abutment with respect to the second element. The thermally resistant and/or air tight material comprises a thermally resistant and/or air tight flexible mineral wool material, rubber-like material or a foam, such for example an elastomeric interlaced foam based on synthetic rubber (Armaflex), a polyethylene foam, a polyurethane foam, a polypropylene foam or a polyvinyl chloride foam, to facilitate placement thereof into the safing slot. In a preferred embodiment of the present invention, the connecting third element and the second element are made from the same material. Preferably, the connecting third element is of a rectangular form. A straight joint or connecting third element can be sufficient to maintain complete seal of the safing slot.

Preferably, the connecting third element is installed in a last step, after the first and second element have been positioned and secured within the safing slot of a curtain wall structure.

In order to further maintain a complete seal extending within the safing slot, in particular with regard to a seal against smoke and/or when using mineral wool as an insulation material, the thermal insulating and sealing system may further comprise an outer fire retardant coating positioned across the second element and the adjacent portions of the interior wall surface of the interior panel and the floor located thereadjacent. The sealing characteristics of the construction shown in the present invention can be significantly enhanced by the application of such fire retardant coating.

Generally, such outer fire retardant coatings are applied by spraying or other similar means of application. Such outer fire retardant coatings are for example firestop joint sprays, preferably based on water, and self-leveling silicon sealants. Preferably, the outer fire retardant coating has a wet film thickness of at least ⅛ in. Additionally, it is preferable that the outer fire retardant coating overs the top of the second element overlapping the outer edge of the floor and the interior face of interior wall surface of the interior panel by a min of ½ in.

One aspect of the present invention provides for a top framing component for use within the spandrel area of a curtain wall construction defined by an interior wall surface including one or more framing members and at least one floor spatially disposed from the interior wall surface of the curtain wall construction, wherein the top framing component is preferably a compartment having a base and at least two sides, preferably perpendicular or trapezoidal, to the base with an opening parallel to the base. Preferably, the top framing component is in form of a U-shaped, rectangular channel. In an alternative embodiment the top framing component is a compartment constructed from four sides perpendicular or trapezoidal to the base with an opening parallel to the base. The top framing component of the present invention can be installed on site and hence is part of a modular or prefabricated curtain wall design and forms part of the thermal insulating and sealing system. Top-mounting the framing member to the spandrel panel has the advantage that the façade design is not altered and that the framing member can be fixed in various back pan designs. A top framing component having a base and at least two sides, preferably perpendicular or trapezoidal, to the base with an opening parallel to the base, has the advantage that the insulation material can be oversized at the sides thereby improving the sealing between adjacent elements and allows for a simple manufacturing of the top framing component filled with an insulation material ready for installation on site.

The top framing component according to the present invention, for use in a curtain wall construction, may comprise additional ledges for fixing the top framing component to the interior panel, preferably a metal steel back pan. The additional ledges are located at the base, perpendicular to the base, allowing for top-mounting to the top of the interior wall surface of the spandrel panel.

Additionally, the top framing component may comprise a pre-compressed flexible sealing element, such as a thermally resistant and/or air tight material, such as a thermally resistant and/or air tight flexible mineral wool material, rubber-like material or a foam, such for example an elastomeric interlaced foam based on synthetic rubber (Armaflex), a polyethylene foam, a polyurethane foam, a polypropylene foam or a polyvinyl chloride foam, to facilitate placement thereof into the safing slot. In particular, the thermally resistant and/or air tight material may be an open-cell or closed-cell foam-based material, for example a polyurethane-based or silicone-based material. In a particular preferred embodiment of the present invention, the thermally resistant and/or air tight material is thermally resistant flexible mineral wool material, a polyurethane foam or an elastomeric interlaced foam based on synthetic rubber.

In order to hold the pre-compressed flexible sealing element in place, the top framing component comprises a cover foil or cover lid. This cover foil or lid may be made from a plastic material, such as for example polyethylene-material. It can also be a net or a grid made from materials known to a person skilled in the art. Preferably, the top framing component comprises a polyethylene foil. This foil of the top framing component preferably has a perforation. The foil is used to cover the flexible sealing element and protects it from water and other environmental influence which may have an impact on the material. Due to the pre-compression, the sealing element will expand upon tearing or cutting off the perforation and extends the top framing component to close the safing slot between the interior wall surface and the adjacent floor. The sealing element can compensate different joint widths caused by tolerances and movement. The sealing element can either be pre-installed in the façade element or installed on job site. It is preferred that the sealing element is already integrated in the façade element.

The thermal insulating and sealing system according to the present invention is preferably for use with a building construction having a curtain wall construction defined by an interior wall surface including one or more framing members and at least one floor spatially disposed from the interior wall surface of the curtain wall construction defining the safing slot extending between the interior wall surface of the curtain wall construction and an outer edge of the floor.

In particular, the building construction comprises a thermally insulating and sealing system for effectively thermally insulating and sealing of the safing slot, wherein the thermal insulating and sealing system comprises:

i) a first element comprising a top framing component, which is a compartment having a base and at least two sides, preferably perpendicular or trapezoidal to the base with an opening parallel to the base, positioned substantially in the height of the floor, on top of the interior wall surface of the spandrel panel so that its opening is parallel and pointing away from the exterior wall surface of the spandrel area, and ii) a second element comprised of a thermally resistant and/or air tight material for insulating, positioned at least partially in the top framing component of the first element, wherein the second element includes:

a) an inner end surface positionable in abutment with respect to the outer edge of the floor for sealing thereadjacent, b) an outer end surface positionable in abutment with respect the interior wall surface of the top framing component, c) a lower facing surface extending between the inner end surface and the outer end surface and facing downwardly therebetween, and d) an upper facing surface extending between the inner end surface and the outer end surface and facing upwardly therebetween, and iii) a connecting third element comprised of a thermally resistant and/or air tight material for insulating, positioned in front of the vertical framing member and in abutment with respect to the second element, wherein the top framing component is made from rigid material, preferably steel, and wherein the thermally resistant and/or air tight material comprises a thermally resistant and/or air tight flexible mineral wool material, rubber-like material or a foam.

The thermal insulating and sealing system as well as the spandrel panel and the top framing component according to the present invention is also for acoustically insulating and sealing of a safing slot of a curtain wall structure. The material used for insulating may be of a sound resistant and/or air tight material, such as a mineral wool material, rubber-like material or a foam, such for example an elastomeric interlaced foam based on synthetic rubber (Armaflex), a polyethylene foam, a polyurethane foam, a polypropylene foam or a polyvinyl chloride foam.

While the invention is particularly pointed out and distinctly described herein, a preferred embodiment is set forth in the following detailed description which may be best understood when read in connection with the accompanying drawings.

In FIG. 1 is shown a side cross-sectional view of an embodiment of the thermal insulating and sealing system between the outer edge of a floor and the interior wall surface of the interior panel having a top framing component. In particular, the thermally insulating and sealing system for effectively thermally insulating and sealing of a safing slot 1 within a building construction having a curtain wall construction 2 defined by an interior wall surface 3, including one or more framing members 4 and a spandrel area 5, and at least one floor 6 spatially disposed from the interior wall surface 3 of the curtain wall construction 2. The thermal insulating and sealing system comprises a first element 7, such as a spandrel panel, comprising a top framing component 8 having an interior wall surface and an opening, positioned substantially in the height of the floor, wherein the top framing component is located on top of the spandrel area 5 of the interior wall surface 3, and a second element 9 comprised of a thermally resistant and/or air tight material for insulating, such as a thermally resistant flexible mineral wool material, a polyurethane foam or an elastomeric interlaced foam based on synthetic rubber, positioned in the top framing component 8 of the first element 7, wherein the second element 9 includes an inner end surface 10 positionable in abutment with respect to the outer edge 11 of the floor for sealing thereadjacent, an outer end surface 12 positionable in abutment with respect the interior wall surface 13 of the top framing component 8, a lower facing surface 14 extending between the inner end surface 10 and the outer end surface 12 and facing downwardly therebetween, and an upper facing surface 15 extending between the inner end surface 10 and the outer end surface 12 and facing upwardly therebetween. The top framing component 8 is a compartment having a base and at least two sides, preferably perpendicular or trapezoidal, most preferably perpendicular, to the base with an opening parallel to the base. As shown in FIG. 1, the top framing component of the spandrel area is in form of a U-shaped, rectangular channel. The top framing component 8 is positioned with its base on top of the interior wall surface 3 of the spandrel panel 7 so that its opening is parallel and pointing away from the exterior wall surface of the spandrel panel 7 within the spandrel area 5 of the interior wall surface 3 so that its opening is parallel and pointing away from the exterior wall surface of the spandrel area 5. The top framing component 8 is made from steel. Not shown in FIG. 1 is that an outer fire retardant coating may be positioned across the second element 9 and the adjacent portions of the interior framing member 4 of the curtain wall construction and the floor 5 located the read jacent.

Figure 2:
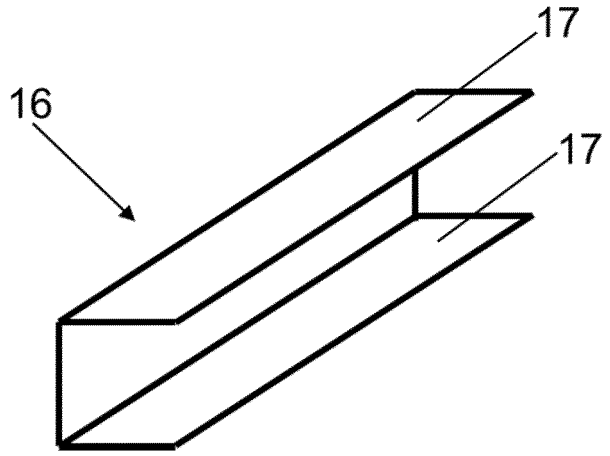
FIG. 2 shows a perspective view of an embodiment of a top framing component for installation to a steel back pan.

In FIG. 2 is shown a perspective view of an embodiment of a top framing component 16 for installation to a steel back pan. The top framing component is for use on top of the spandrel area 5 of a curtain wall construction and is a compartment having a base and at least two sides 17, preferably perpendicular or trapezoidal, most preferably perpendicular, to the base with an opening parallel to the base. The top framing component as shown is in form of a U-shaped, rectangular channel.

Figure 3:
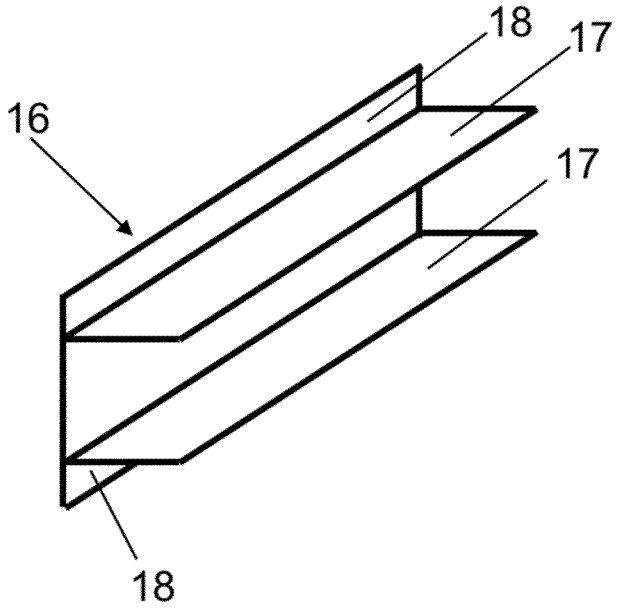
FIG. 3 shows a perspective view of another embodiment of a top framing component having additional ledges for installation to a steel back pan.

In FIG. 3 is shown a perspective view of another embodiment of a top framing component 16 for installation to a steel back pan. This top framing component 16 comprises additional ledges 18 for fixing the top framing component to the interior panel, preferably a metal steel back pan. The additional ledges are located at the base, perpendicular to the base, allowing for top-mounting to the top of the interior wall surface of the spandrel panel.

Figure 4:
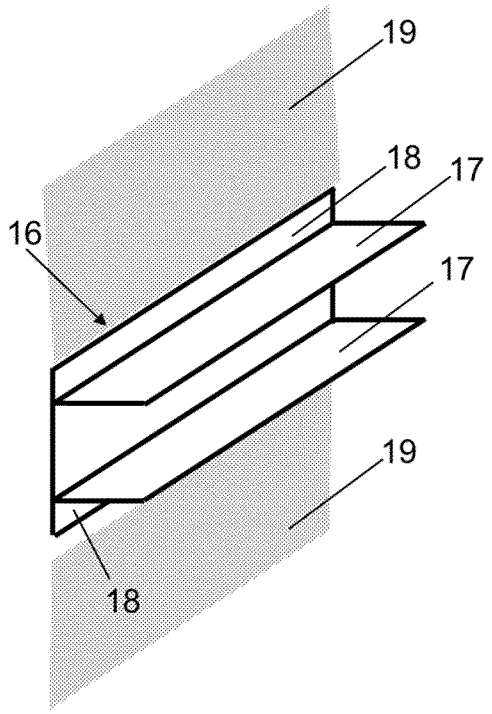
FIG. 4 shows a perspective view of an embodiment of spandrel panel comprising a top framing component.

FIG. 4 shows a perspective view of the embodiment of a spandrel panel comprising a top framing component 16 as shown in FIG. 3 installed to a metal steel back pan 19.

Figure 5:
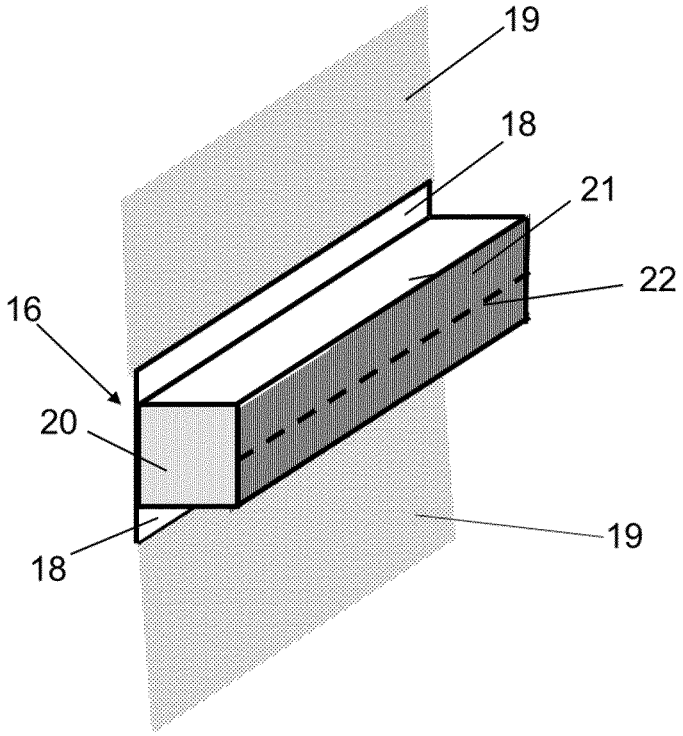
FIG. 5 shows a perspective view of another embodiment of spandrel panel comprising a top framing component installed to a metal steel back pan and filled with a thermally resistant and/or air tight material for insulating.

FIG. 5 shows a perspective view of the embodiment of a spandrel panel comprising a top framing component installed to a metal steel back pan 19 and filled with a thermally resistant and/or air tight material for insulating. The top framing component 16 is a top framing component 16 as depicted in FIG. 3. The rectangular compartment of the top framing component 16 comprises additional ledges 18 for fixing the top framing component 16 with its base on top of the interior wall surface of the spandrel panel, preferably a metal steel back pan 19. The top framing component 16 comprises a pre-compressed elastic sealing element 20, preferably a thermally resistant and/or air tight flexible mineral wool material, rubber-like material or a foam, and a cover foil 21. The pre-compressed elastic sealing element 20 is held in place by a cover foil 21 or lid. This cover foil or lid is made from a plastic material, such as for example polyethylene-material. It can also be a net or a gird made from materials known to a person skilled in the art. In the embodiment shown in FIG. 5, the cover foil 21 is a polyethylene foil. This foil 21 of the top framing component 16 has a perforation 22, which can be torn or cut off. Due to the pre-compression, the sealing element will expand upon tearing of the perforation and extends the top framing component to close the safing slot between the interior wall surface and the adjacent floor.

It should be appreciate that these embodiments of the present invention will work with many different types of insulating materials used for the insulation means of thermally resistant and/or air tight material and with many different types and shapes of the top framing component as long as the material is suitable for maintaining the seal of the safing slot.

It has been shown, that the thermal insulating and sealing system for sealing between the edge of a floor and an interior panel of the present invention maintains sealing of the safing slots surrounding the floor of each level in a building despite deforming of the interior panels especially those back pans made of various materials such as metal or the like which are positioned extending across the interior expanse of the curtain walls.

Furthermore, the thermal insulating and sealing system effectively creates a continuous fireproofing seal extending from the outermost edge of the floor to the curtain wall structure and, in particular, to abutment with or even within a top framing component in the interior panel extending across the curtain wall surface.

It has been shown that a top framing component positioned with its base on top of the interior wall surface of the spandrel panel of a curtain wall structure enhances sealing within a safing slot by penetration of the thermally resistant and/or air tight material for insulating deep into it and in consequence the former linear gap between joint insulation and metal pan surface is transformed to a labyrinth seal which has higher tolerance against movement and leads to an increased fire-resistance.

Top-mounting the framing member to the spandrel panel has the advantage that the façade design is not altered and that the framing member can be fixed in various back pan designs.

It has been further shown that the thermal insulation and sealing system according to the present invention is easily installable from the top or bottom, i.e. a one-sided application.

Further, the thermal insulating and sealing system is not limited to a specific joint width or spandrel height; on face installation on the transom is possible and there is no limitation of vertical as well as horizontal movement capacities of the joint system. The thermal insulating and sealing system provides a clear separation of movement and tolerance compensation as well as reduction of the final movement joint width to a minimum which leads to improved fire-resistance. It has been shown that the thermal insulating and sealing system is able to compensate dimensional tolerances of the concreted floor and to allow movement between the floor and the façade element caused by load, temperature or wind load.

Moreover, the spandrel panel including the top framing component or the top framing component alone, can be installed on site and hence is part of a modular or prefabricated curtain wall design. It can be integrated in the façade assembly providing an increase of installation efficiency, thereby reduce installation failures. It has been shown that a top framing component having a base and at least two sides, preferably perpendicular or trapezoidal, to the base with an opening parallel to the base, has the advantage that the insulation material can be oversized at the sides thereby improving the sealing between adjacent elements and allows for a simple manufacturing of the top framing component filled with an insulation material ready for installation on site.

As such, the thermal insulating and sealing system of the present invention provides a system for effectively maintaining a complete seal in a safing slot when utilizing modular curtain wall constructions which include interior panels extending across the interior surface thereof as is commonly utilized currently for modular or prefabricated designs.

Finally, it has been shown that the thermal insulating and sealing system as well as the spandrel panel and the top framing component according to the present invention is also for acoustically insulating and sealing of a safing slot of a curtain wall structure.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

The invention claimed is:

1. A spandrel panel, comprising:

an exterior wall surface, an interior wall surface, and a top framing component comprising at least two sides and a base, the at least two sides and the base being external to the interior wall surface;

wherein said spandrel panel is suitable for use in a curtain wall construction defined by the interior wall surface comprising one or more framing members and at least one floor spatially disposed from the interior wall surface of the curtain wall construction.

2. The spandrel panel according to claim 1, wherein the top framing component is in form of a U-shaped, rectangular channel.

3. The spandrel panel according to claim 1, wherein the top framing component is positioned with its base on top of the interior wall surface of the spandrel panel so that its opening is parallel and pointing away from the exterior wall surface of the spandrel panel.

4. The spandrel panel according to claim 1, wherein the top framing component is made from a rigid material.

5. The spandrel panel according to claim 1, wherein the top framing component is filled with a thermally resistant and/or air tight material for insulating.

6. A method for acoustically insulating and sealing a safing slot of a curtain wall structure, comprising installing the spandrel panel of claim 1 in the curtain wall structure.

7. A thermally insulating and sealing system, comprising:

(i) a first element comprising a top framing component having an interior wall surface and an opening, positioned in a height of a floor, wherein the top framing component is located on top of the interior wall surface of a spandrel panel, the top framing component comprising at least two sides and a base, the at least two sides and the base being external to the interior wall surface, and (ii) a second element comprising a thermally resistant and/or air tight material for insulating, positioned at least partially in the top framing component of the first element, wherein the second element comprises:

(a) an inner end surface positionable in abutment with respect to an outer edge of the floor for sealing thereadjacent, (b) an outer end surface positionable in abutment with respect the interior wall surface of the top framing component, (c) a lower facing surface extending between the inner end surface and the outer end surface and facing downwardly therebetween, and (d) an upper facing surface extending between the inner end surface and the outer end surface and facing upwardly therebetween;

wherein the thermally insulating and sealing system thermally insulates and seals a safing slot within a building construction having a curtain wall construction defined by interior wall surface, comprising one or more framing members and a spandrel area, and at least one floor spatially disposed from the interior wall surface of the curtain wall construction defining the safing slot extending between the interior wall surface of the curtain wall construction and an outer edge of the floor.

8. The thermally insulating and sealing system according to claim 7, wherein the top framing component is positioned on top of the interior wall surface of the spandrel panel so that its opening is parallel and pointing away from the exterior wall surface of the spandrel area.

9. The thermally insulating and sealing system according to claim 7, wherein the top framing component is made from rigid material.

10. The thermally insulating and sealing system according to claim 7, wherein the thermally resistant and/or air tight material comprises a thermally resistant and/or air tight flexible mineral wool material, rubber-like material or a foam to facilitate placement thereof into the safing slot.

11. The thermally insulating and sealing system according to claim 10, wherein the thermally resistant and/or air tight material is a resistant flexible mineral wool, a polyurethane foam or an elastomeric interlaced foam based on synthetic rubber.

12. The thermally insulating and sealing system according to claim 11, wherein the thermally resistant and/or air tight material comprises a thermally resistant and/or air tight flexible mineral wool material, rubber-like material or a foam to facilitate placement thereof into the safing slot.

13. The thermally insulating and sealing system according to claim 7, further comprising an outer fire retardant coating positioned across the second element and the adjacent portions of the interior framing member of the curtain wall construction and the floor located thereadjacent.

14. A top framing component for use within the spandrel area of a curtain wall construction defined by an interior wall surface comprising one or more framing members and at least one floor spatially disposed from the interior wall surface of the curtain wall construction, wherein the top framing component is a compartment having a base and at least two sides, the at least two sides and the base being external to the interior wall surface.

15. The top framing component according to claim 14, wherein the top framing component is in form of a U-shaped, rectangular channel.

16. The top framing component according to claim 14, wherein the top framing component comprises ledges for fixing the top framing component to an interior panel.

17. The top framing component according to claim 14, comprising a pre-compressed elastic sealing element and a cover foil.

18. A building construction having a curtain wall construction defined by an interior wall surface comprising one or more framing members and at least one floor spatially disposed from the interior wall surface of the curtain wall construction defining the safing slot extending between the interior wall surface of the curtain wall construction and an outer edge of the floor, comprising a thermally insulating and sealing system for thermally insulating and sealing of the safing slot, wherein the thermal insulating and sealing system comprises:

(i) a first element comprising a top framing component, which is a compartment having a base and at least two sides, positioned in the height of the floor, on top of the interior wall surface of a spandrel panel so that its opening is parallel and pointing away from the exterior wall surface of a spandrel area, the top framing component comprising at least two sides and a base, the at least two sides and the base being external to the interior wall surface, and (ii) a second element comprising a thermally resistant and/or air tight material for insulating, positioned at least partially in the top framing component of the first element, wherein the second element comprises:

(a) an inner end surface positionable in abutment with respect to the outer edge of the floor for sealing thereadjacent, (b) an outer end surface positionable in abutment with respect the interior wall surface of the top framing component, (c) a lower facing surface extending between the inner end surface and the outer end surface and facing downwardly therebetween, and (d) an upper facing surface extending between the inner end surface and the outer end surface and facing upwardly therebetween, and (iii) a connecting third element comprising a thermally resistant and/or air tight material for insulating, positioned in front of the vertical framing member and in abutment with respect to the second element, wherein the top framing component is made from rigid material, and wherein the thermally resistant and/or air tight material comprises a thermally resistant and/or air tight flexible mineral wool material, rubber-like material or a foam.

* * * * *